US009745835B2

(12) United States Patent
Cunningham et al.

(10) Patent No.: US 9,745,835 B2
(45) Date of Patent: Aug. 29, 2017

(54) DOWNHOLE SCREEN TRACER RETENTION

(71) Applicant: HALLIBURTON ENERGY SERVICES, INC., Houston, TX (US)

(72) Inventors: Gregory Scott Cunningham, Grapevine, TX (US); Travis Thomas Hailey, Jr., Sugar Land, TX (US); Ryan Michael Novelen, Grand Prairie, TX (US); Stephen Michael Greci, Little Elm, TX (US); James Jun Kang, Dallas, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 182 days.

(21) Appl. No.: 14/398,155

(22) PCT Filed: Oct. 31, 2013

(86) PCT No.: PCT/US2013/067643

§ 371 (c)(1),
(2) Date: Oct. 31, 2014

(87) PCT Pub. No.: WO2015/065403

PCT Pub. Date: May 7, 2015

(65) Prior Publication Data

US 2016/0281475 A1 Sep. 29, 2016

(51) Int. Cl.

| | |
|---|---|
| ***E21B 47/11*** | (2012.01) |
| ***E21B 43/10*** | (2006.01) |
| ***E21B 43/08*** | (2006.01) |
| ***E21B 47/10*** | (2012.01) |
| ***E21B 33/12*** | (2006.01) |

(52) U.S. Cl.
CPC ..... *E21B 43/08* (2013.01); *E21B 33/12* (2013.01); *E21B 43/10* (2013.01); *E21B 47/1015* (2013.01)

(58) Field of Classification Search
CPC ..... E21B 43/08; E21B 47/1015; E21B 33/12
See application file for complete search history.

(56) References Cited

U.S. PATENT DOCUMENTS

| | | | | |
|---|---|---|---|---|
| 2004/0084186 | A1 | 5/2004 | Allison | |
| 2007/0241277 | A1 | 10/2007 | Stray et al. | |
| 2011/0024111 | A1 | 2/2011 | Moen et al. | |
| 2013/0075090 | A1 | 3/2013 | Woiceshyn | |
| 2013/0112400 | A1 | 5/2013 | Woiceshyn et al. | |
| 2015/0060059 | A1* | 3/2015 | Langlais | E21B 47/1015 166/250.12 |

OTHER PUBLICATIONS

Australian Patent Application No. 2013404002 , Examination Report No. 1, mailed May 19, 2016, 3 pages.
International Patent Application No. PCT/US2013/067643, International Search Report and Written Opinion mailed Jul. 24, 2014, 13 pages.

* cited by examiner

*Primary Examiner* — Brad Harcourt
(74) *Attorney, Agent, or Firm* — Kilpatrick Townsend & Stockton LLP

(57) ABSTRACT

A screen assembly can include a tracer retaining mechanism for retaining a tracer in an annular area defined between a screen portion and a base pipe. The tracer retaining mechanism can be coupled to the screen portion, the base pipe, or the tracer. The tracer retaining mechanism can allow fluid flow in and out of the annular area.

18 Claims, 12 Drawing Sheets

DOWNHOLE SCREEN TRACER RETENTION

CROSS-REFERENCE TO RELATED APPLICATIONS

This is a U.S. national phase under 35 U.S.C. 371 of International Patent Application No. PCT/US2013/067643, titled "Downhole Screen Tracer Retention" and filed Oct. 31, 2013, the entirety of which is incorporated herein by reference.

TECHNICAL FIELD

The present disclosure relates generally to subassemblies for retaining tracers in screen assemblies in wellbores through subterranean formations.

BACKGROUND

Tracers can include chemicals or other substances that are leached out by wellbore fluids over time in a wellbore. The tracer chemicals or substances can be detected in fluid produced from the wellbore at the surface for, among other things, determining the zone that is producing the fluid. Retaining tracers in a zone, or with respect to a screen joint in a zone, can be challenging. In most screen joints the fluid produced (or injected) through the joint passes through openings in the base pipe of that joint, and tracers can be easily contained within an annular space between the filter media of the joint and the base pipe of the joint by closing the annular space at each axial end of the joint. In some screen variations, however, the annular space between the filter media and the base pipe is connected across multiple screen joints, and the fluid produced (or injected) through the joints must pass through the annular space to a relatively few flow controlled openings located within special screen joints or between screen joints. In these screen variations, it is desirable to retain the tracers in a fixed position within each screen joint so that the tracers cannot move along the annular space when fluid is flowing in the annular space.

DETAILED DESCRIPTION

Certain aspects and features relate to retaining a tracer within an annular area between a base pipe and a screen of a screen assembly for a wellbore through a subterranean formation. Fluid flow can be allowed within the annular area and fluid can flow among different screen assemblies within the same zone of the wellbore while tracers in the screen assemblies are retained.

Tracers of various types, sizes, and shapes can be installed in screen assemblies of various types (e.g., mesh, wire wrap, etc.). For example, tracers may be rods, strips, or any shape. The screen assemblies can have open ends such that fluid can flow in and out of the ends of the screen assemblies, and in an annular area between an inner portion of a screen and a base pipe. A "base pipe" as used herein can include any type of pipe or other tubular element associated with, or included in, one or more screen assemblies. Tracers can be retained within the screen assemblies by tracer retaining mechanisms during shipping, handling, running downhole in the wellbore, and during well production as fluid flow is passing through the annular area.

Tracer retaining mechanisms may be rings, tracer material, clips, other suitable devices or components, or a combination of these. The tracer retaining mechanisms can be coupled to base pipes, tracers, or screens, and with respect to ends of screen assemblies. Tracer retaining mechanisms according to some aspects are removable from the screen assemblies and re-installable within the screen assemblies. For example, a tracer retaining mechanism and a tracer can be removed at a rig site to offer enhanced flexibility, along with security in retaining the tracer.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
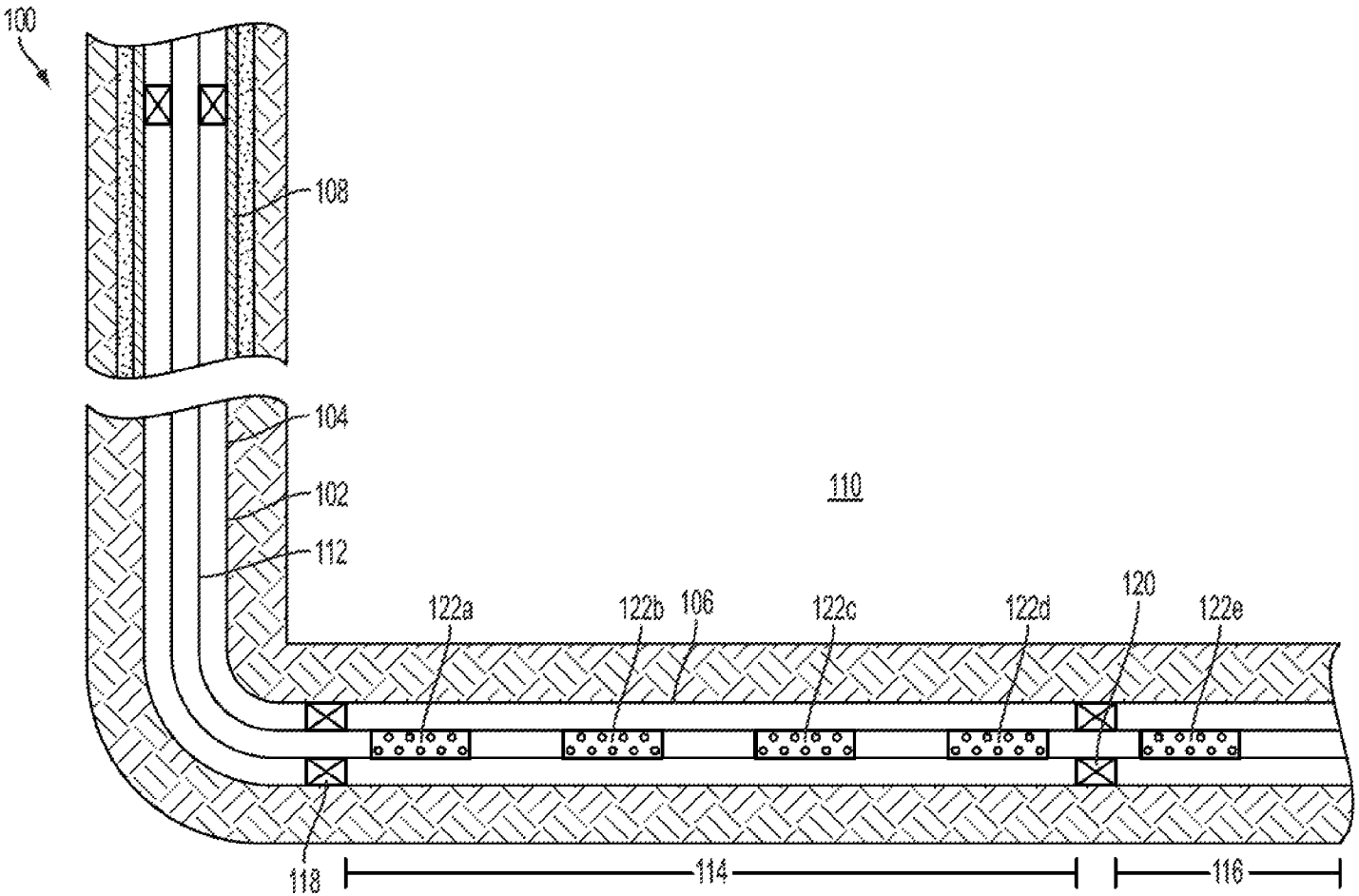
FIG. 1 is a schematic illustration of a well system having production zones that include screen assemblies with tracer retaining mechanisms according to one aspect.

FIG. 1 depicts a well system 100 with screen assemblies that include tracer retaining mechanisms according to certain aspects. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. The tubing string 112 can include production zones 114, 116 separated, for example, by packers 118, 120 for producing wellbore fluid. Production zone 114 can be between the packers 118, 120. Production zone 116 can be between packer 120 and another packer (not shown) or an end (not shown) of the wellbore. The production zones 114, 116 can include screen assemblies 122*a-e*. Production zone 114 includes screen assemblies 122*a-d*. Production zone 116 includes screen assembly 122*e* shown in FIG. 1, but may include additional screen assemblies. Each of the screen assemblies 122*a-d* may include components for the production of wellbore fluid. The components can include inflow control devices and screens, and can be associated with production openings in the tubing string 112. In some aspects, one of the screen assemblies 112*a-d* is associated with production openings in the tubing string 112 and the other screen assemblies 112*a-d* in production zone 114 filter and direct fluid flow toward that screen assembly.

Each of the screen assemblies 122*a-e* can include a tracer that can leach chemicals or other substances into wellbore fluid and the chemicals or other substances can be detected from produced fluid at the surface of the wellbore. Each of the screen assemblies 122*a-e* can also include a tracer retaining mechanism for retaining the tracer within the screen assembly and allowing wellbore fluid to flow in an annular area between a screen and a base pipe.

Although FIG. 1 depicts screen assemblies 122*a-e* in the substantially horizontal section 106, screen assemblies according to various aspects can be located, additionally or alternatively, in the substantially vertical section 104. Furthermore, any number of screen assemblies 122*a-e*, including one, can be used in the well system 100 generally or in each production zone. In some aspects, screen assemblies 122*a-e* can be disposed in simpler wellbores, such as wellbores having only a substantially vertical section. Screen assemblies 122*a-e* can be disposed in open hole environments, such as is depicted in FIG. 1, or in cased wells.

Figure 2:
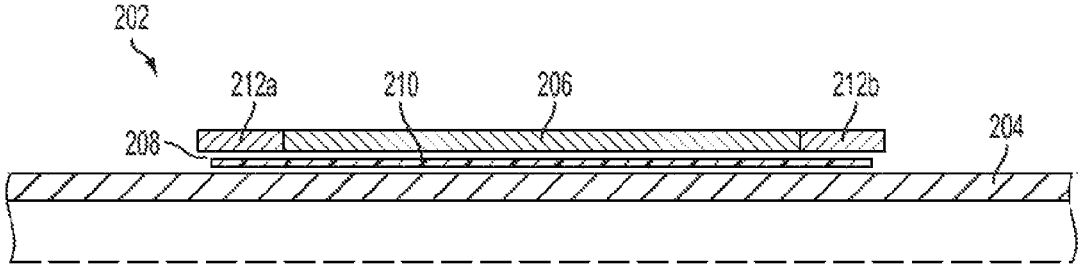
FIG. 2 is a cross-sectional side view of a screen assembly with a tracer retaining mechanism that is a ring according to one aspect.
Figure 3:
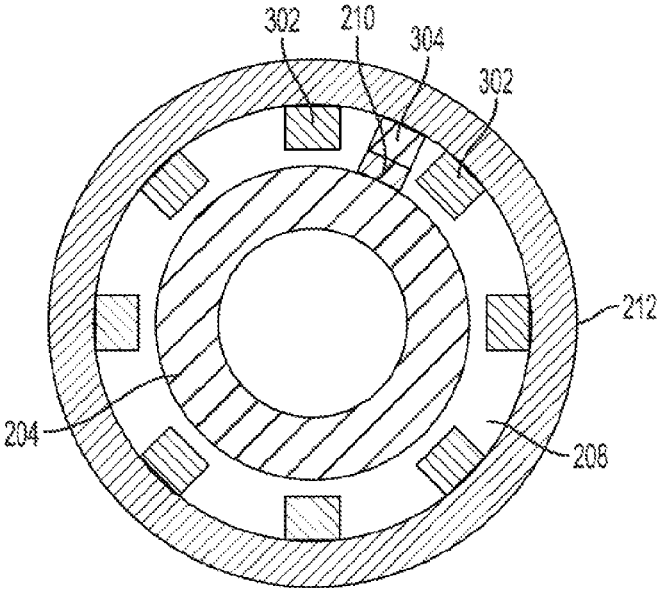
FIG. 3 is an end view of the tracer training mechanism of FIG. 2 according to one aspect.

FIG. 2 depicts by cross-sectional side view part of a screen assembly 202 according to one aspect. The screen assembly 202 includes a base pipe 204 and a screen portion 206. The screen portion 206 and the base pipe 204 define an annular area 208 in which a tracer 210 is located. The annular area 208 can be defined between an inner part, such as an inner diameter, of the screen portion 206 and an outer part, such as an outer diameter, of the base pipe 204. The screen assembly 202 also has a tracer retaining mechanism that includes disc members that are rings 212*a-b* coupled to each end of the screen portion 206. In some aspects, the rings 212*a-b* are cast rings. Each of the rings 212*a-b* can include channel-defining members and protrusions extending from an inner part of the rings 212*a-b* toward the base pipe 204. FIG. 3 is an end view of a ring 212 with channel-defining members 302 and a protrusion 304 according to one aspect. The channel-defining members 302 extend from an inner diameter of the ring 212 toward the base pipe 204 and define channels in the annular area 208 in which tracers, such as tracer 210, can be located. Fluid flow in and out of each end of the screen assembly 202 of FIG. 2 can be allowed in the channels. The protrusion 304 extends from the inner diameter of the ring 212 toward the base pipe 204 and into a channel. The protrusion 304 can prevent axial movement by the tracer 210 that is beyond the ends of the screen assembly 202 of FIG. 2. Any number of channel-defining members and protrusions can be used. In some aspects, the channel-defining members 302 and the protrusion 304 are integral with the ring 212. In other aspects, the channel-defining members 302 and the protrusion 304 are coupled to the ring 212, such as by a weld. The ring 212, with the channel-defining members 302 and the protrusion 304, can be installed after the tracer 210 is installed.

Figure 4:
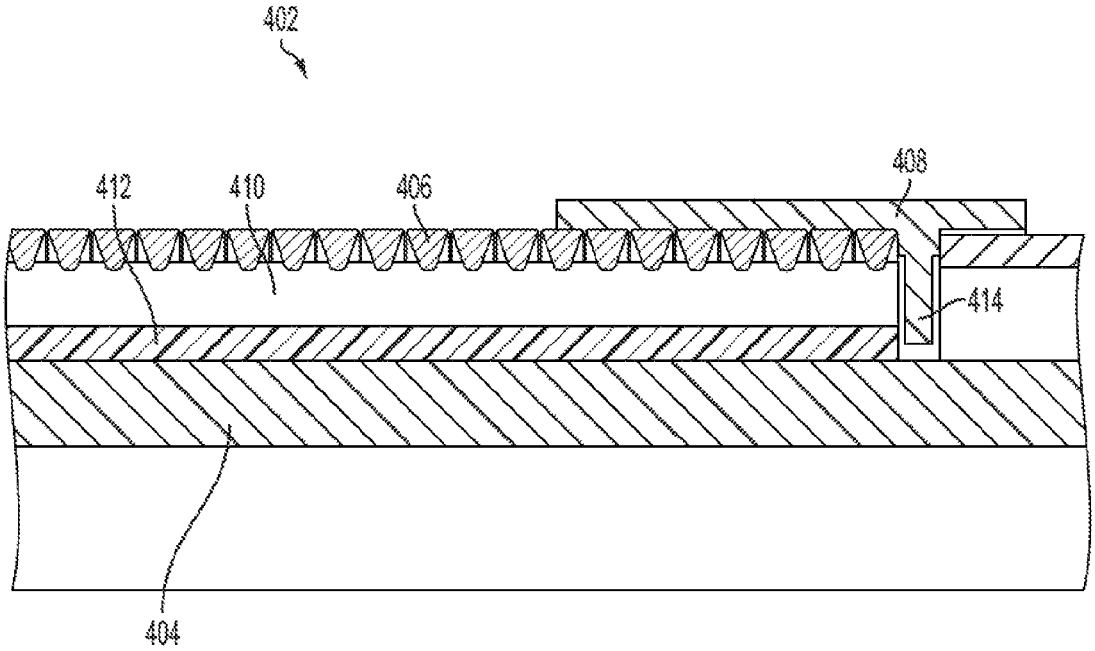
FIG. 4 is a cross-sectional side view of a tracer retaining mechanism that is a ring with protrusions coupled to a screen portion according to one aspect.
Figure 5:
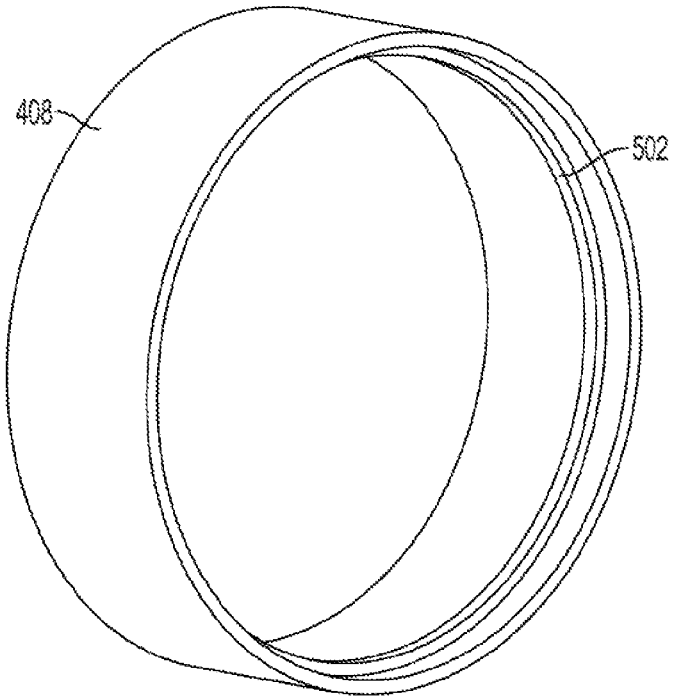
FIG. 5 is a perspective view of a ring without protrusions according to one aspect.
Figure 6:
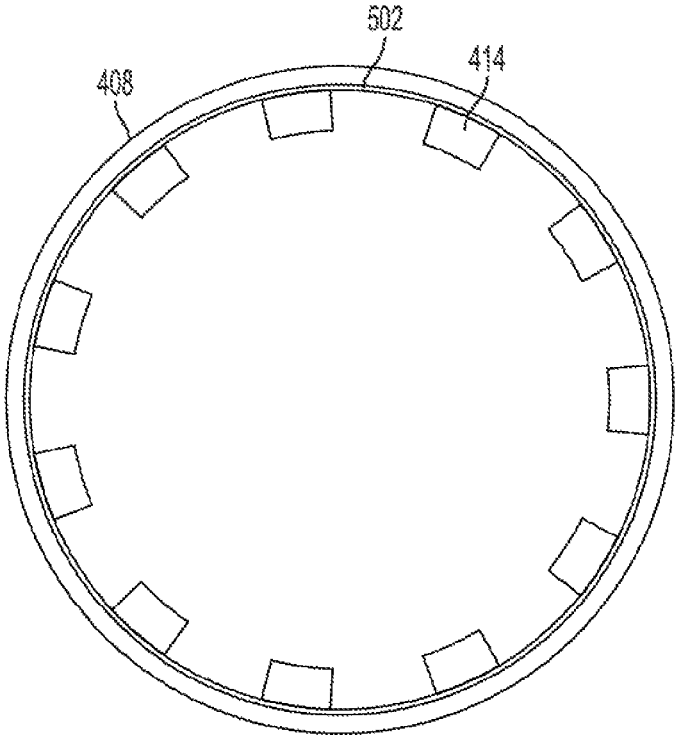
FIG. 6 is an end view of the ring of FIG. 5 with protrusions according to one aspect.

FIG. 4 is a cross-sectional side view of part of a screen assembly 402 according to another aspect. The screen assembly 402 includes a base pipe 404, a screen portion 406, and a tracer retaining mechanism that is a ring 408. The ring 408 may be a shrink ring, a ring that is crimped onto the screen assembly 402, or another type of ring. The screen portion 406 and the base pipe 404 define an annular area 410 in which a tracer 412 is located. The ring 408 can be installed at ends (or in a middle) of the screen assembly 402. The ring 408 includes protrusions 414 that extend into the annular area 410 toward the base pipe 404. The protrusions 414 can prevent the tracer 412 from moving axially beyond the ends of the screen assembly 402. FIG. 5 depicts an example of the ring 408 by perspective view. The ring 408 includes a stop 502 at which protrusions 414 of FIG. 4 can be installed. The stop 502 can be in an inner diameter of the ring 408. In some aspects, a cast ring can be inserted into the inner diameter of the ring 408. In other aspects, as shown, for example, by an end view in FIG. 6, protrusions 414 can be installed at the stop 502 of the ring 408. The protrusions 414 can extend into an annular area away from the inner diameter of the ring 408 and toward a base pipe (not shown). Any number of protrusions 414, including one, can be used.

Figure 7:
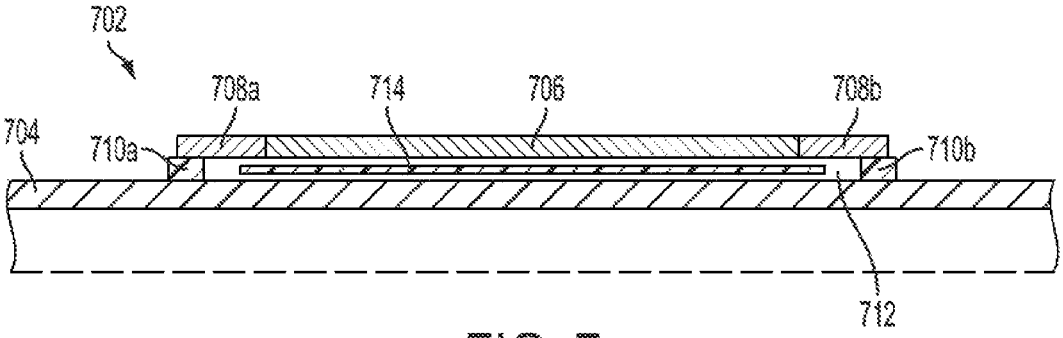
FIG. 7 is a cross-sectional side view of a tracer retaining mechanism that is a ring with channels in which tracer material is positioned according to one aspect.
Figure 8:
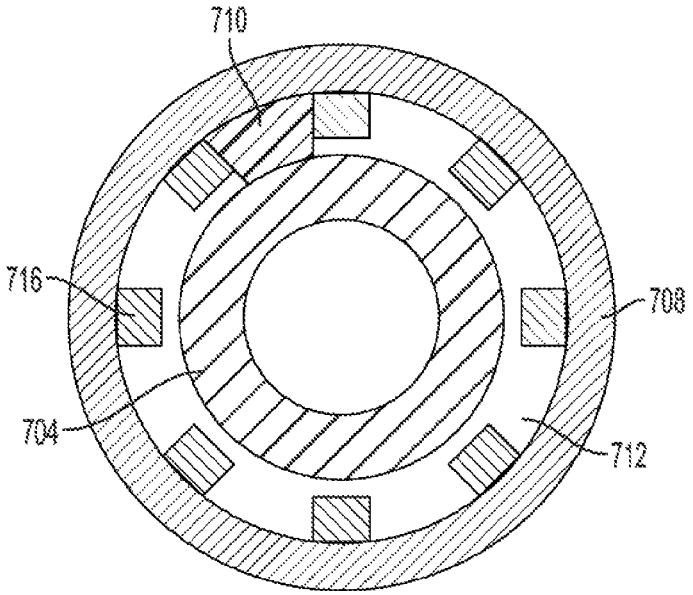
FIG. 8 is an end view of the tracer retaining mechanism of FIG. 7 according to one aspect.

FIG. 7 depicts by cross-sectional side view an example of part of a screen assembly 702 according to another aspect. The screen assembly 702 includes a base pipe 704, a screen portion 706, and a tracer retaining mechanism that includes rings 708*a-b* and tracer material 710*a-b*. The screen portion 706 and the base pipe 704 define an annular area 712 in which a tracer 714 is located. The rings 708*a-b* can each include protrusions that define channels in which the tracer material 710*a-b* can be located and through which fluid can flow to enter and exit the screen assembly 702. For example, the tracer material 710*a-b* can be forced or wedged into a channel such that the tracer material 710*a-b* are retained proximate to ends of the screen assembly 702. FIG. 8 depicts an end view of an example of the tracer retaining mechanism of FIG. 7 with respect to the base pipe 704. The ring 708 includes protrusions 716 extending from an inner part of the ring 708 toward the base pipe 704 and into the annular area 712. The protrusions 716 define channels. Tracer material 710 can be mechanically forced into a channel to prevent the tracer 714 in FIG. 7 from axially moving beyond ends of the screen assembly 702 in FIG. 7. The tracer material 710 can be cut from the tracer 714 in FIG. 7 or be a molded/shaped piece of tracer material shaped to fit the channel at an end of the screen assembly 702. For example, the tracer material 710 can be forced into the channel to create a press or an interference fit. The tracer material 710 can retain the tracer 714 but still allow fluid flow. The tracer material 710 can be removable and re-installable to allow for removal of the tracer 714 at a rig site or otherwise at a surface of the wellbore.

Figure 9:
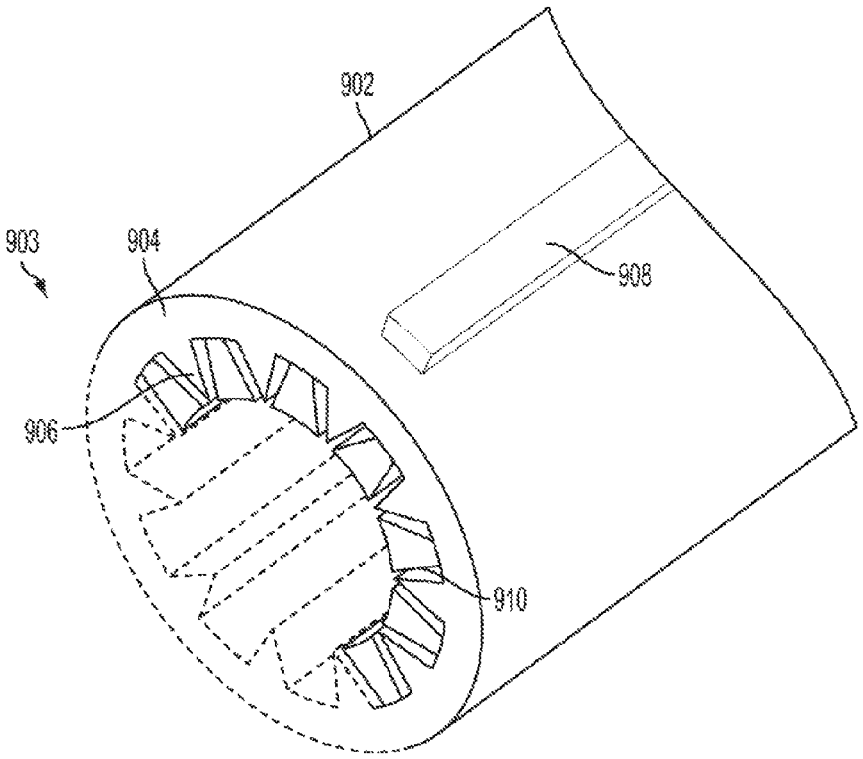
FIG. 9 is a partially transparent perspective view of a tracer retaining mechanism that includes protrusions according to one aspect.
Figure 12:
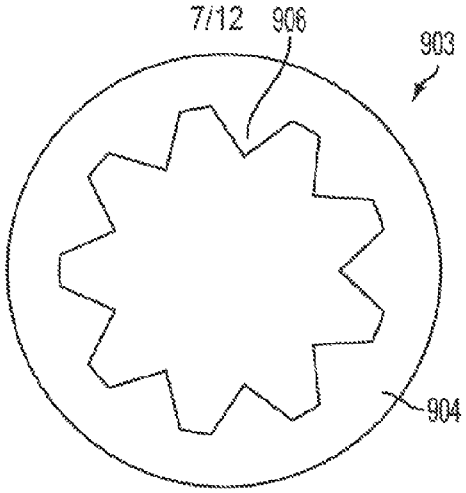
FIG. 12 is an end view of a tracer retaining mechanism that is a disc with protrusions according to one aspect.

FIG. 9 depicts by partially transparent perspective view part of a screen assembly 902 with a tracer retaining mechanism 903 according to one aspect. The tracer retaining mechanism 903 includes a retainer ring 904 at an end of the screen assembly 902. Extending from the retainer ring 904 are bendable protrusions 906 that can retain a tracer 908 that is positioned in a channel defined by rib wire 910 within the screen assembly 902 by preventing the tracer 908 from moving axially beyond the screen assembly 902. Each bendable protrusion 906 can correspond to a flow path or open area in the screen assembly 902. The bendable protrusions 906 can be selectively bent to further increase flow rates along flow paths and for flow entering and exiting the screen assembly 902. FIG. 12 depicts by end view the tracer retaining mechanism 903 of FIG. 9 with a retainer ring 904 and bendable protrusions 906 extending inwardly from the retainer ring 904.

Figure 10:
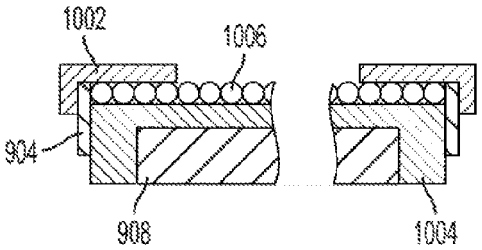
FIG. 10 is a cross-sectional view of a screen assembly with the tracer retaining mechanism of FIG. 9 according to one aspect.
Figure 11:
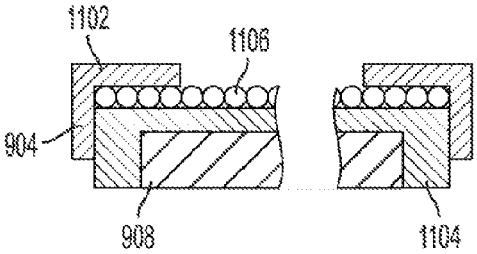
FIG. 11 is a cross-sectional view of a screen assembly with the tracer retaining mechanism of FIG. 9 according to another aspect.

FIG. 10 is a cross-sectional view of part of the screen assembly 902 of FIG. 9 according to one aspect. The retainer ring 904 is wedged between a ring 1002, a screen body 1004 and a screen portion 1006 to lock the retainer ring 904 in place after the ring 1002 is set. The ring 1002 may be a shrink ring. The tracer 908 is retained after the ring 1002 is set. FIG. 11 is a cross-sectional view of part of the screen assembly 902 of FIG. 9 according to another aspect. The retainer ring 904 is a shrink ring 1102, or is otherwise integral with the shrink ring 1102, that can couple to an end of the screen assembly 902 of FIG. 9 with respect to a screen body 1104 and a screen portion 1106 for retaining the tracer 908. For example, the shrink ring 1102 may be heated and set into place to lock in the tracer 908. In other aspects, the shrink ring 1102 is replaced with another type of ring, such as a ring that is crimped onto the screen assembly 902 of FIG. 9.

Figure 13:
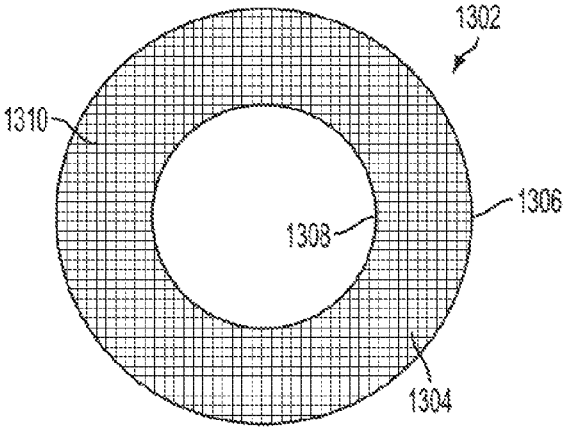
FIG. 13 is an end view of a tracer retaining mechanism that is a disc with mesh according to one aspect.
Figure 14:
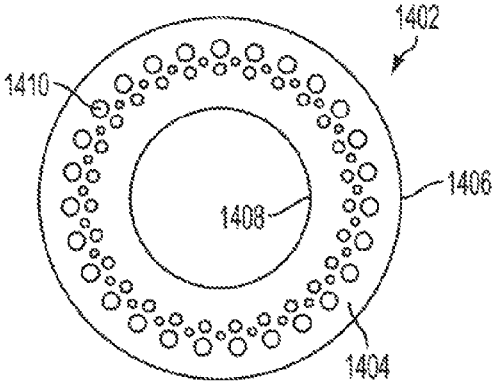
FIG. 14 is an end view of a tracer retaining mechanism that is a disc with perforations according to one aspect.

In other aspects, tracer training mechanisms with retainer rings usable in connection with the screen assembly 902 of FIG. 9 may be formed differently. FIG. 13 depicts by end view an example of a tracer retaining mechanism 1302 that can replace the tracer retaining mechanism 903 in the screen assembly 902 of FIG. 9. The tracer retaining mechanism 1302 includes a retainer ring 1304 that has an outer wall 1306 and an inner wall 1308. Between the outer wall 1306 and the inner wall 1308 is a disc that includes mesh 1310. The mesh 1310 can allow fluid flow in and out of the screen assembly 902 of FIG. 9 while retaining a tracer within the screen assembly 902. FIG. 14 depicts by end view another example of a tracer retaining mechanism 1402 that can replace the tracer retaining mechanism 903 in the screen assembly 902 of FIG. 9. The tracer retaining mechanism 1402 includes a retainer ring 1404 that has an outer wall 1406 and an inner wall 1408. Between the outer wall 1406 and the inner wall 1408 is a disc that includes a perforated surface 1410. The perforated surface 1410 can allow fluid flow in and out of the screen assembly 902 of FIG. 9 while retaining a tracer within the screen assembly 902.

Figure 15:
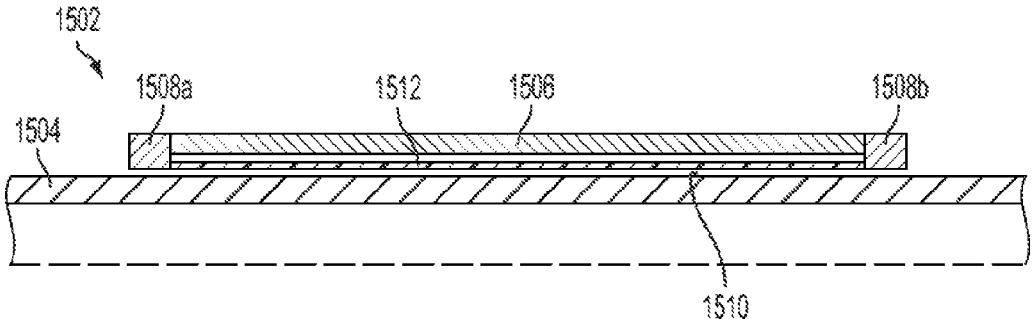
FIG. 15 is a cross-sectional side view of a screen assembly with a tracer retaining mechanism that includes removable rings according to one aspect.

FIG. 15 depicts by cross-sectional side view part of a screen assembly 1502 according to another aspect. The screen assembly 1502 includes a base pipe 1504, a screen portion 1506, and a tracer retaining mechanism that includes end rings 1508*a-b* coupled at each end of the screen portion 1506. The screen portion 1506 and the base pipe 1504 define an annular area 1510 in which a tracer 1512 is located. The end rings 1508*a-b* extend toward the base pipe 1504 and can prevent the tracer 1512 from moving axially beyond each end of the screen assembly 1502. The end rings 1508*a-b* can be removable and re-installable to allow for the removal or other reconfiguration of the tracer 1512, such as at a rig site or otherwise at a surface of the wellbore. For example, the end rings 1508*a-b* may be detachably coupled to the screen portion 1506 by a screw or another type of connection. In some aspects, the end rings 1508*a-b* allow fluid flow between the end rings 1508*a-b* and the base pipe 1504 such that wellbore fluid can enter and exit the screen assembly 1502 at ends of the screen assembly 1502. In other aspects, the end rings 1508*a-b* seal onto the screen portion 1506 and the base pipe 1504 to create a seal.

Figure 16:
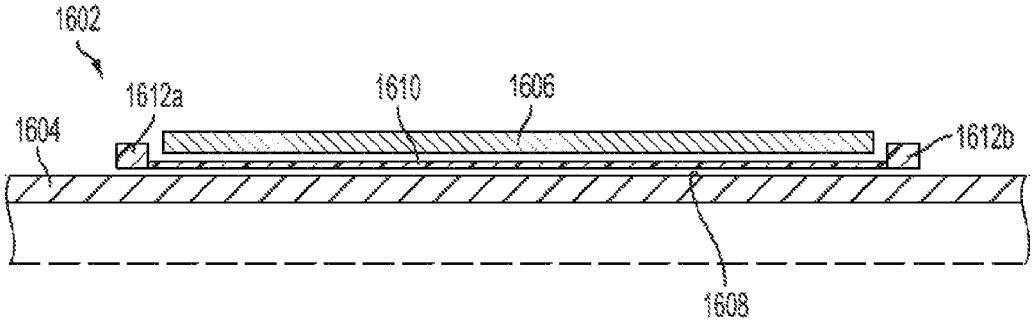
FIG. 16 is a cross-sectional side view of a screen assembly with a tracer retaining mechanism that includes tracer material on ends of a tracer according to one aspect.

FIG. 16 depicts by cross-sectional side view an example of part of a screen assembly 1602 according to one aspect. The screen assembly 1602 includes a base pipe 1604 and a screen portion 1606 with open ends. The screen portion 1606 and the base pipe 1604 define an annular area 1608 in which a tracer 1610 is located. Part of the tracer 1610 extends outside the ends of the screen portion 1606. The screen assembly 1602 includes a tracer retaining mechanism that is tracer material 1612*a-b* coupled to the ends of the tracer 1610 and extending radially away from the base pipe 1604. The tracer material 1612*a-b* can prevent the tracer 1610 from moving completely out of the annular area 1608, while allowing fluid flow in and out of the annular area 1608, by contacting ends of the screen portion 1606 as the tracer 1610 moves axially. The tracer material 1612*a-b* can be a cut piece of the tracer 1610 or molded from material of another tracer. In other aspects, material different from tracer material can replace the tracer material 1612*a-b*. The tracer material 1612*a-b* can be glued to the tracer 1610, heated together with the tracer 1610, or attached to the tracer 1610 by another mechanism. The tracer material 1612*a-b* can be removable and re-installable, such as being breakable and attachable at the rig site so that the tracer 1610 can be removed or installed at the rig site.

Figure 17:
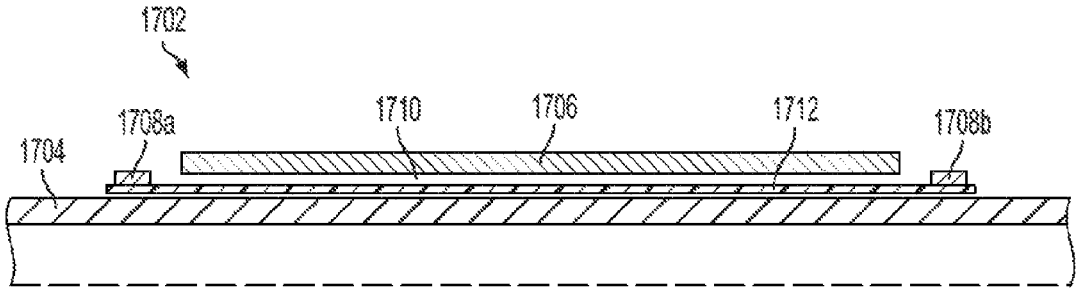
FIG. 17 is a cross-sectional side view of a screen assembly with a tracer retaining mechanism that includes retaining rings on ends of tracer material according to one aspect.
Figure 18:
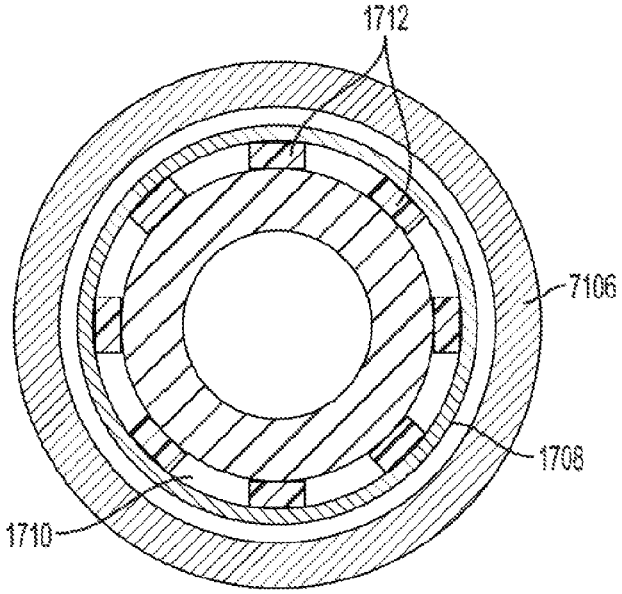
FIG. 18 is an end view of the screen assembly of FIG. 17 according to one aspect.

FIG. 17 is a cross-sectional side view of an example of part of a screen assembly 1702 according to one aspect. FIG. 18 is an end view of the screen assembly 1702. The screen assembly 1702 includes a base pipe 1704, a screen portion 1706, and a tracer retaining mechanism that includes rings 1708*a-b* proximate to the ends of the screen portion 1706. The screen portion 1706 and the base pipe 1704 define an annular area 1710 in which a tracer 1712 is located. Part of the tracer 1712 extends outside of the ends of the screen portion 1706. The rings 1708*a-b* are installed at ends of the tracer 1712 to couple the tracer 1712 to the base pipe 1704 to prevent axial movement by the tracer 1712 while allowing fluid to enter and exit the annular area 1710. The rings

1708*a-b* can be shrink fit onto the tracer 1712 (such as by using controlled heat to maintain tracer integrity). In other aspects, the rings 1708*a-b* are split c-rings bolted together, a hose clamp-type ring that is screwed together, or some other components for mechanically coupling to the tracer 1712 and the base pipe 1704. The rings 1708*a-b* may be removable and re-installable to allow for tracer removal at a rig site.

Figure 19:
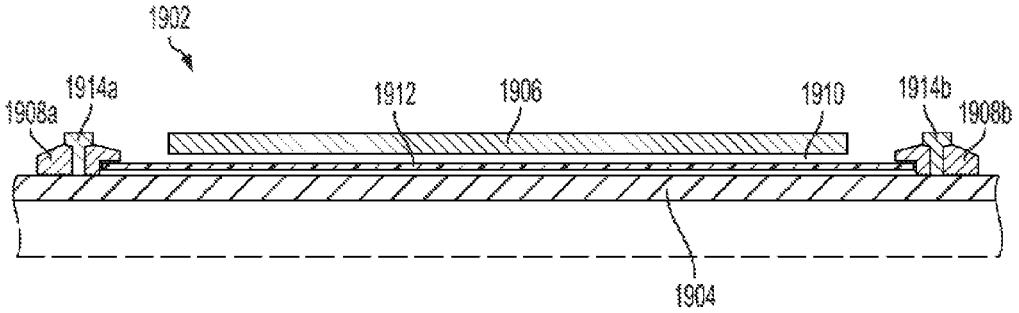
FIG. 19 is a cross-sectional side view of a screen assembly with a tracer retaining mechanism that includes rings coupled to a base pipe at ends of the tracer according to one aspect.

FIG. 19 is a cross-sectional side view of an example of part of a screen assembly 1902 according to one aspect. The screen assembly 1902 includes a base pipe 1904, a screen portion 1906, and a tracer retaining mechanism that includes rings 1908*a-b*. The screen portion 1906 and the base pipe 1904 define an annular area 1910 in which is located a tracer 1912. Part of the tracer 1912 extends outside of the ends of the screen portion 1906. The rings 1908*a-b* can be installed onto each end of the tracer 1912 and can prevent the tracer 1912 from moving axially and radially. The rings 1908*a-b* can be detachably coupled to the base pipe 1904 using bolts 1914*a-b* or another type of mechanism. One or more of the rings 1908*a-b* can be removed, at a rig site for example, such that the tracer 1912 can be removed from or installed in the screen assembly 1902. The rings 1908*a-b* can be installed after the screen portion 1906 is welded to the base pipe 1904 or one of the rings 1908*a-b* can be bolted onto the base pipe 1904 before the tracer 1912 is installed and the other ring can then be bolted down.

Figure 20:
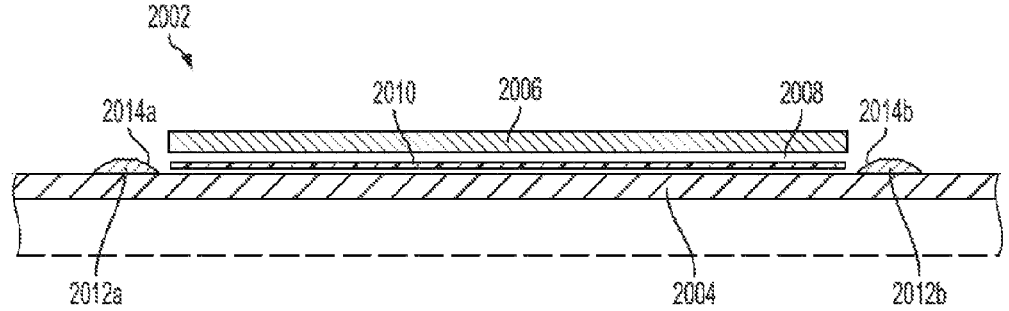
FIG. 20 is a cross-sectional side view of a screen assembly with a tracer retaining mechanism that includes ramped rings positioned with respect to ends of the tracer according to one aspect.

FIG. 20 is a cross-sectional side view of part of a screen assembly 2002 according to one aspect. The screen assembly 2002 includes a base pipe 2004 and a screen portion 2006 that define an annular area 2008. A tracer 2010 is located in the annular area 2008. The screen assembly 2002 includes a tracer retaining mechanism that includes rings 2012*a-b* proximate to ends of the screen portion 2006. The rings 2012*a-b* have ramps 2014*a-b* facing the annular area 2008 that retain the tracer 2010 within the annular area 2008 by preventing the tracer 2010 from moving beyond the rings 2012*a-b* according to loads typically experienced on tracers in a downhole environment. The rings 2012*a-b* can be welded or bolted to the base pipe 2004. In some aspects, the rings 2012*a-b* have a profile that allows the tracer 2010 to be installed within the annular area 2008 subsequent to the rings being coupled to the base pipe 2004, but retain the tracer 2010 after the tracer 2010 is installed.

Figure 21:
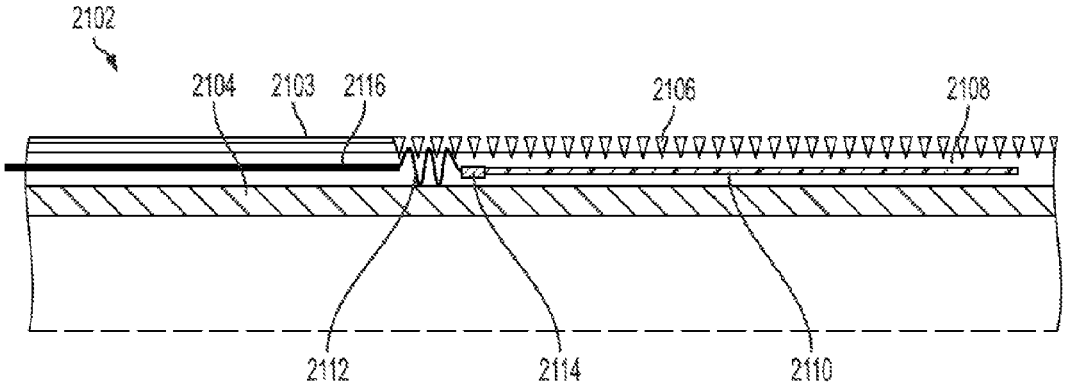
FIG. 21 is a cross-sectional side view of a screen assembly with a tracer retaining mechanism that includes a retention clip detachably coupled to another part of the screen assembly and to a tracer through a tracer holder according to one aspect.

FIG. 21 is a cross-sectional side view of part of a screen assembly 2102 according to one aspect. The screen assembly 2102 includes a ring 2103. In some aspects, the ring 2103 is a cast ring. The screen assembly 2102 also includes a base pipe 2104 and a screen portion 2106 that define an annular area 2108. A tracer 2110 is positioned within the annular area 2108. The screen assembly 2102 includes a tracer retaining mechanism that is a retention clip 2112 in an inner area of the screen portion 2106 and coupled to the tracer 2110 through a tracer holder 2114. The retention clip 2112 can engage with part of the screen portion 2106 for retaining the tracer 2110 within the annular area 2108. In other aspects, the retention clip 2112 can engage with, or otherwise be coupled to by interference fit, for example, an inner part of the ring 2103, the base pipe 2004, or both, instead of the screen portion 2106. Coupled to the retention clip 2112 on an opposite side than the tracer holder 2114 is a removal rod 2116. In some aspects, the removal rod 2116 is permanently coupled with the retention clip 2112. In other aspects, the removal rod 2116 is detachably coupled with the retention clip 2112. Fluid can flow in and out of the annular area 2108 around the retention clip 2112 and the removal rod 2116.

Figure 22:
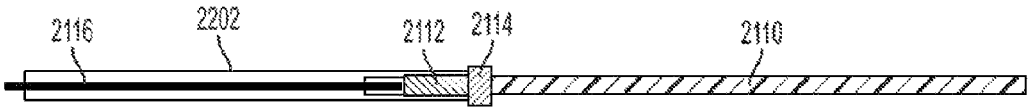
FIG. 22 is a top view of the tracer retaining mechanism of FIG. 21 coupled to a tracer and an insertion tool according to one aspect.
Figure 23:
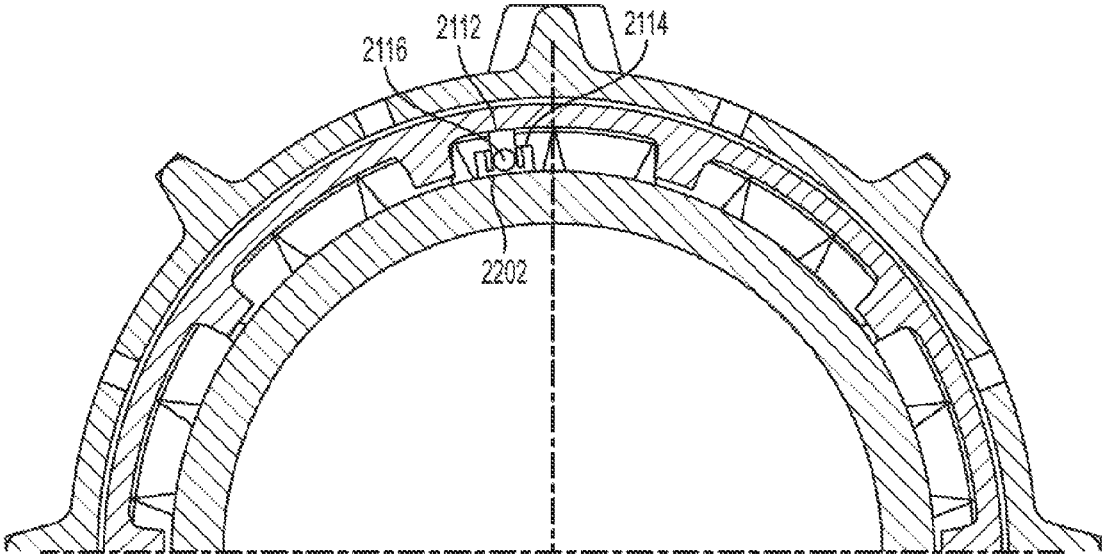
FIG. 23 is a cross-sectional view of part of the screen assembly of FIG. 21 with an insertion tool coupled to the retention clip according to one aspect.

The retention clip 2112 can be installed using an insertion tool 2202 shown in FIGS. 22-23. FIG. 22 depicts a top view of the tracer 2110 coupled to the retention clip 2112 through the tracer holder 2114. The insertion tool 2202 can slide past the retention clip 2112 and press onto the tracer holder 2114. The insertion tool 2202 can push on the tracer holder 2114 to extend the retention clip 2112. The retention clip 2112 can be installed when the insertion tool 2202 is removed. FIG. 23 is a cross-sectional view of part of the screen assembly 2102 of FIG. 21 with the insertion tool 2202 coupled to the retention clip 2112 that is coupled to the tracer holder 2114 according to one aspect. The insertion tool 2202 can straddle the retention clip 2112 and the removal rod 2116 while pushing on the tracer holder 2114 for disengaging the retention clip 2112.

The retention clip 2112 can be removed by pulling on the removal rod 2116 to cause the retention clip 2112 to extend and disengage from the screen portion 2106 in FIG. 21 such that the retention clip 2112, the tracer holder 2114, and the tracer 2110 can be removed.

The foregoing description of the aspects, including illustrated aspects, of the disclosure has been presented only for the purpose of illustration and description and is not intended to be exhaustive or to limit to the precise forms disclosed. Numerous modifications, adaptations, and uses thereof will be apparent to those skilled in the art without departing from the scope of this disclosure.

What is claimed is:

1. A screen assembly, comprising:

a base pipe;

a screen portion cooperatively coupled to the base pipe for defining an annular area between the base pipe and the screen portion, the screen assembly having open ends for fluid flow in and out of the annular area; and a tracer retaining mechanism positioned with respect to the annular area for retaining a tracer within the annular area, the tracer retaining mechanism including (i) protrusions defining channels there between for allowing the fluid flow in and out of the annular area and (ii) a material positioned in at least one of the channels for retaining the tracer in the annular area, wherein the tracer retaining mechanism is detachably coupled to the screen assembly such that the tracer is removable at a rig site.

2. The screen assembly of claim 1, wherein a protrusion extends radially from a stop towards the base pipe from an inner wall of a ring such that the tracer is retained in the annular area at least in part by the protrusion.

3. The screen assembly of claim 1, wherein the protrusions include at least one bendable protrusion for allowing an increase in the fluid flow in and out of the annular area.

4. The screen assembly of claim 1, wherein the protrusions are coupled to removable rings that are encapsulated by shrink rings.

5. The screen assembly of claim 1, wherein the tracer retaining mechanism is coupled to the base pipe for preventing axial and radial movement by the tracer in the annular area.

6. The screen assembly of claim 1, wherein the tracer retaining mechanism includes a cast ring or a shrink ring.

7. The screen assembly of claim 1, wherein the material is tracer material that is separate from the tracer.

8. A screen assembly, comprising:

a screen portion defining an annular area between the screen portion and a base pipe, the annular area being sized for receiving a tracer; and a tracer retaining mechanism coupled to the screen portion, the base pipe, or the tracer for retaining the tracer within the annular area and allowing fluid flow in and out of the annular area, wherein the tracer retaining mechanism includes at least two shrink rings coupled to the screen portion or the base pipe, each of the at least two shrink rings being positioned at an end of the screen portion for retaining the tracer in the annular area.

9. The screen assembly of claim 8, wherein each shrink ring includes a plurality of protrusions of which at least one is bendable.

10. The screen assembly of claim 8, wherein the tracer retaining mechanism includes a ring having a perforated or mesh surface between an inner wall and an outer wall of the ring.

11. The screen assembly of claim 8, wherein each shrink ring includes a plurality of protrusions defining channels there between, and a material is disposed in at least one of the channels for retaining the tracer in the annular area.

12. The screen assembly of claim 11, wherein the material is tracer material that is separate from the tracer.

13. A screen assembly, comprising:

a screen portion defining an annular area between the screen portion and a base pipe, the annular area being sized for receiving a tracer; and a tracer retaining mechanism for maintaining the tracer in position and allowing fluid flow in and out of the annular area, wherein the tracer retaining mechanism includes a removable tracer material, a removable ring, or a removable retention clip, the tracer retaining mechanism coupling at least one end of the tracer material to the screen portion or the base pipe.

14. The screen assembly of claim 13, wherein the tracer is in the annular area and extends beyond each end of the screen portion, and wherein the tracer retaining mechanism includes the removable tracer material coupled to each end of the tracer, the removable tracer material extending radially away from the base pipe and being sized for retaining in the tracer in the annular area.

15. The screen assembly of claim 13, wherein the tracer extends beyond each end of the screen portion, the tracer retaining mechanism is the removable ring, and the removable ring is coupled to an end of the tracer for mechanically coupling the tracer to the base pipe.

16. The screen assembly of claim 15, wherein the removable ring includes at least two removable rings that are bolted to the base pipe at each end of the tracer for preventing axial and radial movement by the tracer in the annular area.

17. The screen assembly of claim 13, wherein the tracer retaining mechanism is the removable retention clip, the removable retention clip is positioned in the annular area and coupled to the tracer through a tracer holder, and the removable retention clip is removable by a removal rod and being insertable by an insertion tool.

18. The screen assembly of claim 13, wherein the tracer retaining mechanism includes rings positioned on and extending radially away from the base pipe, wherein the rings have a ramped surface facing the annular area.

* * * * *